United States Patent [19]

McCabe

[11] 4,099,292

[45] Jul. 11, 1978

[54] TELESCOPING HEAT RESPONSIVE RELEASING MEANS

[76] Inventor: Francis J. McCabe, 239 Hastings Ct., Doylestown, Pa. 18901

[21] Appl. No.: 779,044

[22] Filed: Mar. 18, 1977

Related U.S. Application Data

[63] Continuation-in-part of Ser. No. 676,483, Apr. 13, 1976, Pat. No. 4,041,570, and a continuation-in-part of Ser. No. 676,413, Apr. 13, 1976, Pat. No. 4,040,304.

[51] Int. Cl.[2] ..... E05F 15/20

[52] U.S. Cl. ..... 16/48.5; 160/1

[58] Field of Search ..... 16/48.5; 160/1, 6; 49/2

[56] References Cited

U.S. PATENT DOCUMENTS

| | | | |
|---|---|---|---|
| 1,987,330 | 11/1935 | Fischer | 49/2 |
| 2,635,718 | 4/1953 | Birkemeier | 49/2 X |
| 3,725,972 | 4/1973 | McCabe | 49/2 |
| 3,796,248 | 3/1974 | McCabe | 160/1 |
| 3,796,249 | 3/1974 | McCabe | 106/1 |
| 3,889,314 | 6/1975 | McCabe | 49/2 |

*Primary Examiner*—Ronald Feldbaum

*Attorney, Agent, or Firm*—Benasutti Associates, Ltd.

[57] ABSTRACT

A novel telescoping heat responsive releasing device is described wherein a mounting member on which a bimetallic means is mounted slidingly engages a pawl member which is movable between a first position in which the pawl member is capable of being restrained by the aforementioned bimetallic means, and an actuating position wherein associated apparatus connected to said releasing device may assume the desired heat responsive posture. Various alternate embodiments are illustrated wherein a plurality of bimetallic elements are utilized to engage the pawl member, wherein a bimetallic element is additionally actuated mechanically or electrically, and wherein various pawl and mounting member configurations are illustrated.

9 Claims, 10 Drawing Figures

TELESCOPING HEAT RESPONSIVE RELEASING MEANS

CROSS-REFERENCE TO RELATED APPLICATIONS

The present application is a continuation-in-part of my prior co-pending patent application entitled, "An Electrical Pneumatic Heat Actuated Fire Link Apparatus" Ser. No. 676,483, filed Apr. 13, 1976 now U.S. Pat. No. 4,041,570 as well as, a continuation-in-part of my prior co-pending patent application entitled, "Clutch Motor for Use in Resettable Fire Damper", Ser. No. 676,413, filed Apr. 13, 1976, now U.S. Pat. No. 4,040,304 which applications are incorporated herein by reference as if fully set forth herein.

The present application is also related to my copending patent application entitled, "Smoke, Fire And/or Volume Control Damper" Ser. No. 771,473, filed Feb. 24, 1977, now U.S. Pat. No. 4,080,978, which application is also specifically incorporated herein by reference.

BACKGROUND OF THE INVENTION

The present invention generally relates to releasing devices, and more particularly, releasing devices employing bimetals, which releasing devices are conventionally useful to actuate various fire protection equipment in response to increases in heat in the vicinity of the device.

Conventionally, fusible or meltable releasing devices have been employed, such as fusible links in cables which are held under tension in normal conditions and which are actuated by the melting of the link and the resulting break of the cable.

More recently, bimetallic links, such as those illustrated in my previously issued U.S. Pat. Nos. 3,889,314 entitled, "Heat Actuated Link", and 3,725,972 entitled, "Fire Link and Method of Actuating Same", have been described wherein a mounting element having a bimetallic strip attached thereto, which cooperates therewith, may engage a pawl having an aperture therein which is engaged by the bimetallic element in the normal position and which is released thereby as the tip of the bimetallic element separates from the mounting or striker portion thereof to release the pawl. These bimetallic links have conventionally been installed by attaching a cable to either the pawl, the mounting element, or both in a manner similar to that used for the fusible or meltable links described above. These bimetallic links have exhibited certain advantages over the prior art fusible links in that following a return to normal temperatures, the link may be reset simply by reinserting the pawl into the remaining link assembly.

Unfortunately, prior art devices of the type described above have required that access be provided to the link device so that manual resetting is possible. In certain installations, such as in smoke tunnels, ducts, plenums, etc., human access to reset or replace releasing devices is limited. Additionally, relatively skilled personnel must be employed in order to reset or replace the aforementioned releasing devices. In the case of the bimetallic links, these people must at least understand the proper method of inserting the pawl so that it is properly gripped by the remaining portion of the link.

For one approach to this problem, please refer to my previously issued United States Patent entitled, "Remotely Resettable Fire Damper", U.S. Pat. No. 3,796,248, dated Mar. 12, 1974.

SUMMARY OF THE INVENTION

The present invention is basically an improvement over the devices illustrated in my previously issued U.S. Pat. No. 3,889,314 entitled, "Heat Actuated Link"; U.S. Pat. No. 3,725,972 entitled, "Fire Link and Method of Actuating Same"; and U.S. Pat. No. 3,796,248 entitled, "Remotely Resettable Fire Damper".

Basically, the present invention comprises a telescoping heat responsive releasing device wherein two members are provided which slide with respect to each other between normal and actuated positions. A bimetallic means is mounted on one of said members to respond at least to the ambient temperature therearound, which bimetallic means is adapted to restrain said members relative to each other in the normal or restrained position under normal temperatures, and to release the members in response at least to a predetermined increase in the ambient temperature therearound, whereby the members are allowed to slide to the activated position. Since sliding engagement between the two members the two members is maintained, resetting of the device may be accomplished when normal temperatures are restored merely by relatively sliding the two members back into the normal position, whereupon latching means provided as part of the bimetallic means is adapted to automatically receive and again restrain the members relative to each other.

By way of example, the preferred embodiment of the present invention is adapted for use in such installations as fire doors which are weighted or sprung to move towards their closed positions, but which are preferably normally restrained in the open position by a releasing device. In response to excessive heat or a remote signal, the preferred embodiment of the present invention which is fixedly attached at one end to a stationary mount and at the other end to the fire door, will release the two movable members thereof to allow the weight or other closure mechanism to move the door to the closed position. Even if the door is reopened in the presence of excessive heat or while a remote activating signal is maintained to the bimetallic means, the device will not reset even if the movable members are caused to slide to the normal or restrained position. Once normal temperature (or signal) conditions are re-established, however, the device will automatically reset merely by reopening the fire door at which time the bimetallic means will have assumed a position adapted to re-engage and restrain the two slidable members with respect to each other in the normal position.

Accordingly, the primary object of the present invention is the provision of a telescoping heat responsive releasing device wwhich will reset once normal temperatures (and normal signal conditions) are restored and the various sliding members thereof are recycled through their relative normal (restrained) position.

Another object of the present invention is the provision of an inexpensive fail safe heat responsive releasing device which may be reset by relatively inexperienced personnel.

A further object of the present invention is the provision of a heat responsive releasing device with the above described features which is additionally mechanically or electrically activatable from remote locations while at all times retaining the ability to respond to local conditions of excessive heat.

These and other objects of the present invention will become more apparent from the following more detailed description.

DETAILED DESCRIPTION OF THE DRAWINGS

Figure 1:
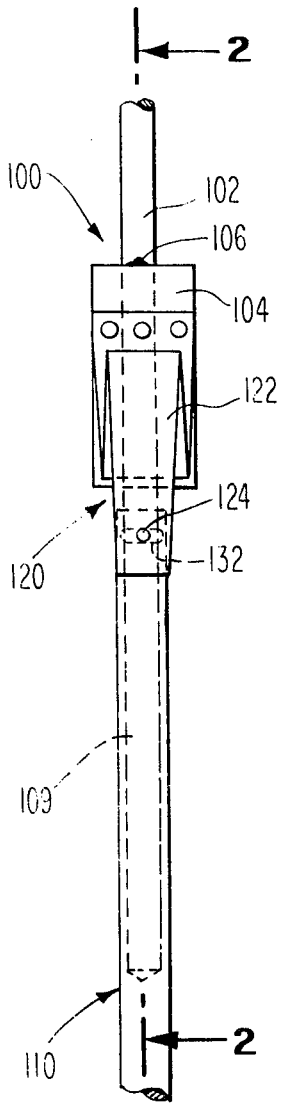
FIG. 1 is a foreshortened top view of a first preferred embodiment of the present invention wherein the mounting member is a rod, the pawl member a tube, and the bimetal a serpentine bimetal.

Although specific forms of the invention have been selected for illustration in the drawings, and the following description is drawn in specific terms for the purpose of describing these forms of the invention, this description is not intended to limit the scope of the invention which is defined in the appended claims.

The telescoping heat responsive releasing device of the present invention generally comprises a mounting member, a pawl member slidably engaging the mounting member, and bimetallic means mounted on said mounting member for restraining said pawl member relative to said mounting member in response to a preselected normal ambient temperature and for releasing said pawl member in response to at least a preselected increase in said ambient temperature, whereby said pawl member and said mounting member may slide relative to each other in response to said releasing action. In each of the preferred embodiments described hereinafter, at least a portion of the mounting member comprises a bearing surface which is complementally configured to an opposing bearing surface on that portion of the pawl member slidingly engaged by said mounting member portion. Accordingly, the pawl member tracks realtively along the mounting member between at least restrained and activated positions defined along said mounting member. In each preferred embodiment, the device will not reset, that is, the ability of the mounting and pawl members to slide relative to each other will not be interfered with at least between the restrained and activated positions as long as increased temperatures or other activation of the bimetallic means continues. Once normal ambient temperature or signal conditions are restored, however, upon the recycling of the pawl member with respect to the mounting member at least through the restrained position, various means are provided to insure the automatic resetting of the device to re-establish the relatively fixed relationship between the two members pending the next activation thereof. In various of the preferred embodiments to be described more fully hereinafter, various means are provided to prevent the relative sliding movement of the pawl and mounting members in at least a first direction beyond the restrained position, which means further insures that the above-described automatic resetting will occur. In other alternative embodiments, means are also provided to insure that the mounting and pawl members will not slide in the opposite direction beyond the actuated position in those embodiments where such means is not provided, it is contemplated that the associated peripheral equipment utilized in connection with the preferred embodiment will limit the travel of the mounting and pawl members relative to each other so that the sliding engagement thereof will, at all times, be maintained.

Although not specifically illustrated in the drawings, it is within the scope of the present invention to provide a means for biasing the mounting and pawl members generally away from said restrained position toward said activated position, so that peripheral means need not be required in order to accomplish the sliding movement of these members relative to each other upon the activation of the device in response to excessive heat (or otherwise). For example, referring to the embodiment shown in FIGS. 1 and 2, it is comtemplated that a spring may be disposed between the tip 107 and terminus 116 of tube portion 112 so that upon movement of the bimetallic means to the position shown in phantom in FIG. 2, the aforementioned biasing means will cause the movement of the mounting and pawl members in the directions illustrated by arrows A and B in FIG. 2.

Figure 2:
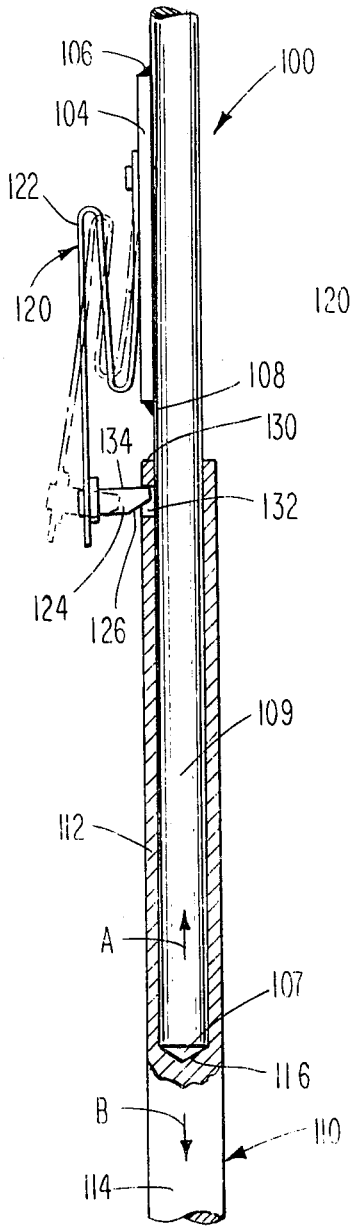
FIG. 2 is an enlarged cross-section taken as indicated by the lines and arrows 2—2 on Fig. 1 of the first preferred embodiment illustrated in Fig. 1 showing the pawl member and mounting member in the restrained position engaged by the bimetallic means, said means being shown in the released position in phantom in Fig. 2.

Referring now to the drawings, and more particularly to FIGS. 1 and 2 of the drawings, the first preferred embodiment releasing device is illustrated. In this embodiment, the mounting member comprises a substantially cylindrical rod 102 and a substantially planar bimetal mounting plate 104 which is attached thereto by welds 106 and 108. The remote end of the rod 102 is shown broken away and when installed would preferably be mounted to an appropriate portion of the associated fire protection equipment with which the releasing device would be used. In each of the embodiments illustrated, the remote ends of the pawl and mounting members may be suitably shaped in order to engage and coact with the particular fire protection apparatus with which it is to be used. In FIG. 1, the pawl member may be seen to comprise a substantially cylindrical member designated generally 110 having a tube portion 112 defined in one end thereof and a solid portion 114 defined at the other end thereof. Accordingly, in this embodiment, the outer surface of the remote end 109 of rod 112 forms the bearing surface of the mounting member while the interior surface of the tube portion 112 of the cylindrical member 110 forms the complementally configured bearing surface of the pawl member. The fact that the cylindrical member 110 is bored to form tube portion 112 only up to a certain pre-defined depth creates a stop between the tip 107 of rod 102 and the terminus 116 of tube portion 112. The mounting and pawl members of the first preferred embodiment are illustrated in FIG. 2 in the normal position thereof with respect to each other.

In the preferred embodiment illustrated in FIGS. 1 and 2, the bimetallic means designated generally 120 comprises a serpentine bimetallic link 122 and a latching means for at least receiving and engaging at least a portion of the pawl member when the pawl is moved relatively away from the activated position into said restrained position when the serpentine bimetal is in the dark link position shown in FIG. 2. This latching means in the embodiment illustrated in FIGS. 1 and 2 comprises a pin 124 extending substantially perpendicularly away from the tip of bimetal 122 and having a beveled surface 126 thereon which rides up over the leading edge 130 of tube portion 112 as the device is being reset. When the device reaches the position shown in FIGS. 1 and 2, the pin 124 snaps into aperture 132 defined in tube portion 112 and pin surface 134 which generally opposes the beveled surface 126 of the pin 124 interferes with the adjacent aperture surface of aperture 132 to prevent rod 102 and cylindrical member 110 from moving in the direction illustrated by arrows A and B in FIG. 2.

For the embodiment shown in FIG. 2, the serpentine bimetal 122 is heat responsive, that is, the bimetal responds to preselected increases in the ambient temperature surrounding the bimetal, which causes the bimetal to assume the position shown in phantom in FIG. 2 which thereby withdraws pin 124 from aperture 132 to release rod 102 from cylindrical member 110 to allow the relative sliding movement of these members in the direction indicated by arrows A and B in FIG. 2.

Figure 3:
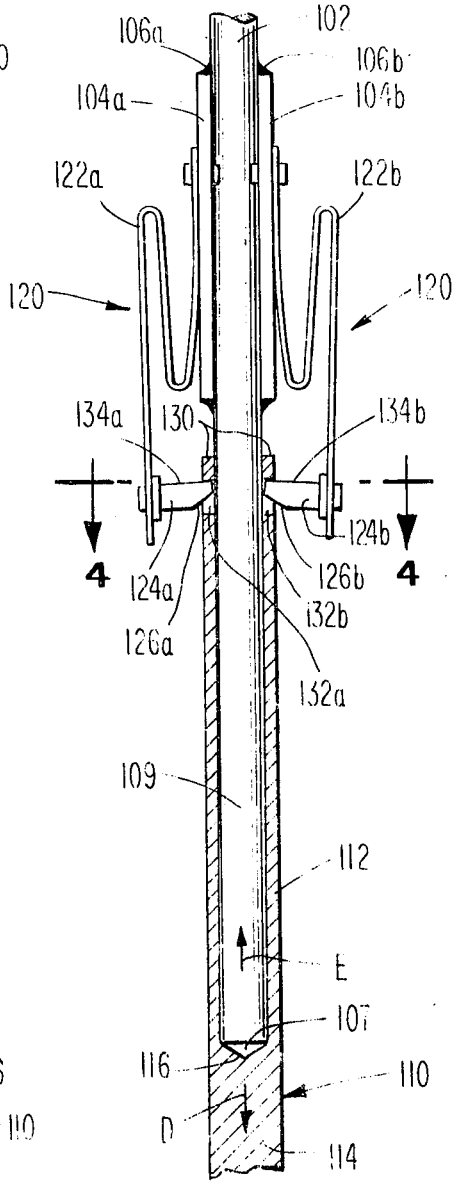
FIG. 3 is an enlarged cross-section similar to the view shown in FIG. 2 but for a second preferred emobodiment of the present invention wherein the bimetallic means comprises two serpentine bimetallic elements and pins which are adapted to mate with apertures formed on generally opposing sides of the pawl member.
Figure 4:
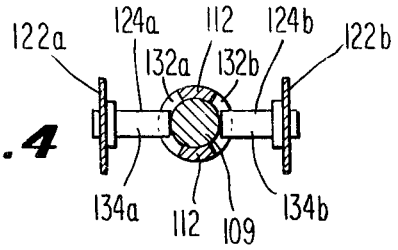
FIG. 4 is a cross-section of the second preferred embodiment illustrated in FIG. 3 taken as indicated by the lines and arrows 4—4 in FIG. 3.

Referring now in particular to FIGS. 3 and 4, a second alternate embodiment of the present invention is illustrated wherein a plurality of bimetals **122*a* and 122*b* are illustrated engaging a plurality of apertures 132*a* and 132*b* respectively. As seen in FIGS. 3 and 4, the various elements of this embodiment are numbered with the same reference numbers as used for the embodiment of FIGS. 1 and 2**, with the exception that those elements which have been duplicated by reason by the use of two bimetals, etc. have been numbered with additional letters "*a*" and "*b*"following the reference numbers for purposes of clarity. In this embodiment, it may be seen that the strength with which the movement of rod 102 and cylindrical member 110 in the direction illustrated by arrows E and D respectively is restrained will be far greater due to the use of a plurality of bimetals **122*a* and 122*b*, and plurality of pins 124*a* and 124*b* which engage a plurality of apertures 132*a* and 132*b*. The automatic resetting function of the device illustrated in FIGS. 3 and 4 will be similar to that illustrated in FIGS. 1 and 2 in that the beveled surfaces 126*a* and 126*b* of the pins will simultaneously ride over leading edge 130 of tube 112, then over the intermediate surface between that leading edge and apertures 132*a* and 132*b*, whereupon the pins will snap into the apertures to create the appropriate interference between surfaces 134*a* and 134*b*** of the pins and the adjacent aperture surfaces.

Figure 5:
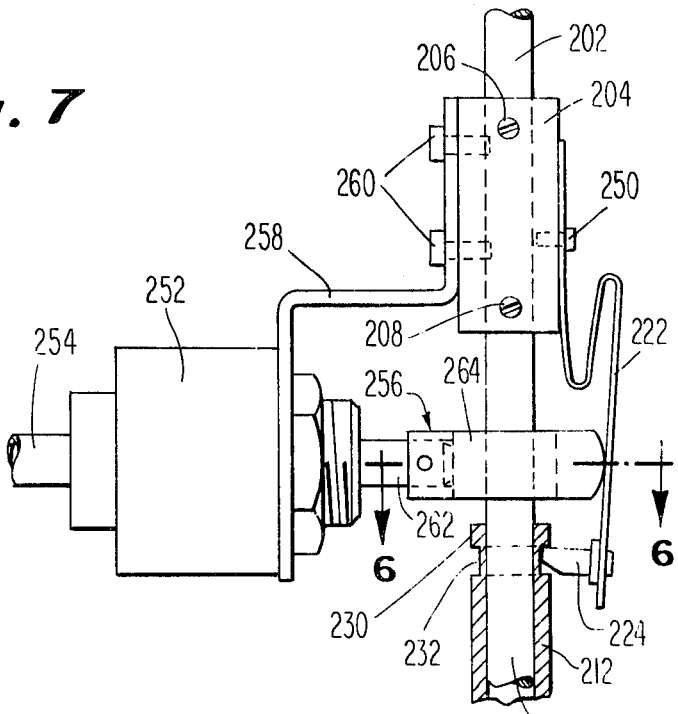
FIG. 5 is a foreshortened side view of a third preferred embodiment of the present invention wherein the bimetallic means further comprises an actuator for additionally actuating the release of the pawl and mounting members for relative slidable movement, this preferred embodiment also illustrating a relatively higher activation temperature serpentine bimetal and a pawl member having an annular groove formed therein to coact with the bimetal pin.
Figure 6:
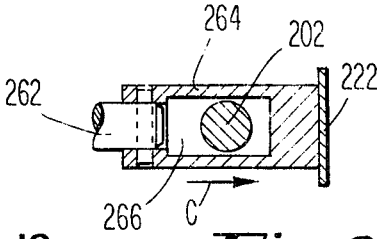
FIG. 6 is a cross-section of a portion of the apparatus illustrated in FIG. 5 taken as indicated by the lines and arrows 6—6 in FIG. 5 showing the disposition of the mounting member extending through an aperture formed in the actuating member, the direction of travel of the actuating member during activation being illustrated by arrow C.

Referring now to FIG. 5, a third alternate embodiment is illustrated wherein the mounting member generally comprises rod 202, and mounting bracket 204 which is screwed into rod 202 by screws 206 and 208. Only a portion of the tube portion 212 of the pawl member is illustrated which coacts with the remote end 209 of rod 202 in a manner similar to that described above, that is, the interior surface of tube portion 112 is a complementally configured bearing surface to the bearing surface presented by the outer surface of rod portion 209 to create a sliding relationship therebetween. In this embodiment, the function of the apertures described in connection with the previous embodiments is preformed by a substantially annular boss 230 and annular groove 232 which suitably replace the apertures described above with the additional advantage that the alignment of the pin 224 and bimetal 222 to which it is attached is no longer important. That is to say, in this embodiment the tube portion 212 may be allowed to freely rotate around the axis of rod 202 while nonetheless insuring that when the tube portion is moved into the position shown in FIG. 5, the beveled surface of the pin 224 will slide over boss 230 and snap into channel 232 regardless of the particular rotational orientation of tube portion 212. As with the previous embodiment described above, bimetal 222 is fixedly attached at the end thereof remote from pin 224 by means of a rivet 250 or other fastening means. The bimetal 222 illustrated in FIG. 5 is a relatively higher temperature bimetal than that illustrated in the previously described figures. In the embodiment illustrated in FIGS. 5 and 6, the bimetallic means further comprises actuator means for additionally releasing the pawl member in response to a remote signal received thereby. This actuator means comprises an actuator 252, signal transmission means 254 for relaying activating information from a remote source, and an actuating member designated generally 256. The actuator means is suitably mounted on the mounting element 202 by bracket 258 which is attached to mounting bracket 204 by means of rivets 260 or other fastening means. The actuator 252 may be a pneumatic or hydraulic cylinder in which case the signal transmission means 254 is a pneumatic or hydraulic line attached thereto. Alternatively, the actuator 252 may be a solenoid in which case the signal transmission means 254 is a wire. The actuating member designated generally 256 comprises a cylinder rod 262 and plunger 264, which plunger has defined therein an aperture 266 which is sufficiently wide to allow rod 202 to extend therethrough and sufficiently long so that the full travel of actuating rod 262 in response to the activation of actuator 252 may be accommodated. Accordingly, referring to FIG. 6 it will be seen that as actuating rod 262 and plunger 264 are moved in the direction of arrow C in FIG. 6 to disengage pin 224 by means of moving its associated bimetal 22 in the direction of arrow C, rod 202 will move relatively to the left within plunger aperture 266. As a result of the mounting of the actuating means and bimetal on substantially opposing sides of rod 202, and further by allowing rod 202 to extend through the plunger aperture 266, the relative alignment of these various elements is substantially assured, that is to say, rod 202 being disposed within the plunger aperture 266 will additionally act to align the stroke of plunger 264 in the direction of arrow C to insure a positive withdraw of pin 224 from annular groove 232.

Figure 7:
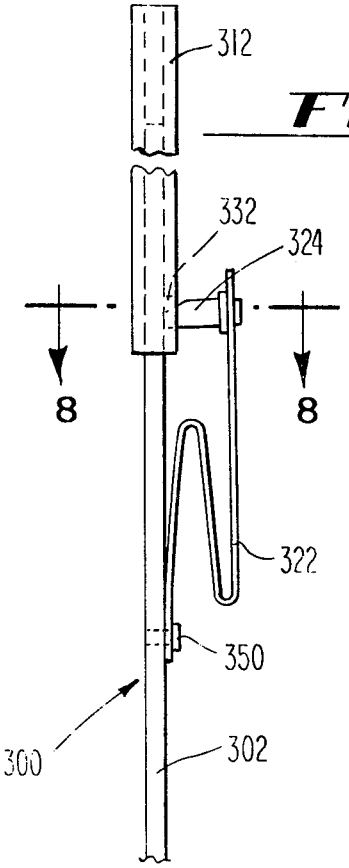
FIG. 7 is a foreshortened side view of a fourth preferred embodiment of the present invention wherein the mounting member is bar-shaped and the pawl member generally channel-shaped.
Figure 8:
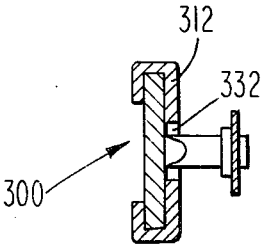
FIG. 8 is a cross-section of the embodiment illustrated in FIG. 7 taken as indicated by the lines and arrows 8—8 in Fig. 7.

Referring now to the fourth preferred embodiment illustrated in FIGS. 7 and 8, it will be seen that the particular geometric configuration of the mounting member and pawl member may be altered, providing the required sliding engagement therebetween is suitably maintained. In the fourth preferred embodiment designated generally 300, the mounting member may simply comprise a mounting bar 302. The bimetallic means comprises bimetal 322 directly riveted to mounting bar 302 by rivets 350, said bimetallic means further comprises a pin 324 having a configuration similar to that described above. The bearing surface of the mounting member in this embodiment comprises the entirety of one of the flat surfaces thereof, the two edge surfaces thereof, and two peripheral portions of the other flat surface thereof. In this embodiment, the pawl member comprises a channel 312, the interior surfaces of which are complementally configured to the aforementioned bearing surfaces of the mounting member to slide therealong. An aperture 332 is appropriately located in one of the surfaces of the pawl member and is adapted to receive pin 324, in the restrained position in response to normal temperatures.

Although each of the embodiments illustrated in the drawings comprise pins having beveled surfaces therein so that the pin is lifted away from the pawl member when the leading edge of the pawl member engages the beveled surface during the resetting of the device, it is also within the scope of the present invention to bevel the leading edge of the pawl member to accomplish the same purpose, that is, to allow the pin to ride up over the end of the pawl member in one direction until the pin reaches a point where it coacts with the pawl member to prevent the pawl member from being moved in the reverse direction, until the pin is positively removed as a result of the action of the remainder of the bimetallic means.

Figure 10:
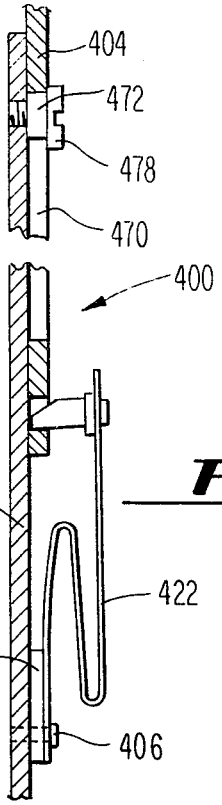
FIG. 10 is a foreshortened enlarged side view of the preferred embodiment illustrated in FIG. 9 taken as indicated by the lines and arrows 10—10 in FIG. 9.
Figure 9:
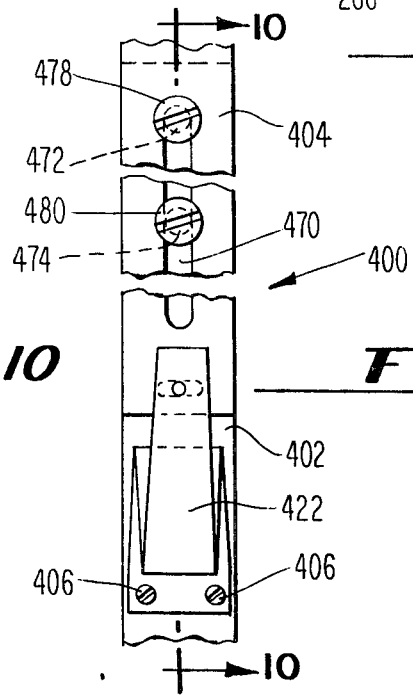
FIG. 9 is a foreshortened top view of a fifth preferred embodiment of the present invention wherein the pawl member and mounting member are both bar-shaped members and wherein the tracking means comprises a slot having a plurality of screws disposed to track therein.

Referring now to FIGS. 9 and 10, which illustrate a fifth preferred embodiment of the present invention designated generally 400, it may be seen that both the mounting member 402 and pawl member 404 of this embodiment comprise substantially flat bar-shaped pieces. The bimetal 422 is again suitably mounted on the mounting member 402 by screws 406 or other suitable fastening means, while in this embodiment thermal insulation 408 is disposed between the bimetal 422 and the mounting element to insulate the bimetal from the heat sink type of action which the mounting element 402 might otherwise exert on the bimetal 422 to prevent the rapid activation thereof. The track means of the embodiment of FIGS. 9 and 10 for limiting the path of sliding engagement between the members and for further maintaining the sliding engagement between the appropriate portions of the mounting and pawl members, comprises a slot 470 having a plurality of tracking bosses 472 and 474 disposed therein. In addition to establishing the tracking axis, these tracking bosses 472 and 474 establish the limits of the path of sliding engagement between the mounting and pawl members. In FIGS. 9 and 10, these members are disposed in the normal or restrained position and tracking boss 472 has come to rest to interfere with one end of slot 470. The actuated position of members 402 and 404 with respect to each other is defined by the interference between tracking boss 474 and the other end of slot 470. In this embodiment, the bearing surfaces of the mounting member comprise a flat surface portion of one end thereof, a portion of the outer surfaces of the tracking bosses 472 and 474 and the undersurface of the retaining heads 478 and 480 which act in cooperation with mounting member 402 to retain pawl member 404 therebetween. This embodiment, which may simply be constructed using screws milled into the configuration shown in FIGS. 9 and 10 is accordingly extremely inexpensive to construct yet, nonetheless, accomplishes many of the objects of the present invention.

It will be understood that various changes in the details, materials and arrangement of parts which have been herein described and illustrated in order to explain the nature of this invention may be made by those skilled in the art within the principle and scope of the invention as expressed in the following claims.

It will further be understood that the "Abstract of the Disclosure" set forth above is intended to provide a non-legal technical statement of the contents of the disclosure in compliance with the Rules of Practice of the United States Patent and Trademark Office, and is not intended to limit the scope of the invention described and claimed herein.

What is claimed is:

1. A heat responsive releasing device, comprising:

(a) a mounting member;

(b) a pawl member slidably engaging said mounting member, said pawl member tracking relatively along said mounting member between at least restrained and activated positions defined along said mounting member; and (c) bimetallic means mounted on said mounting member for restraining said pawl member relative to said mounting member in response to a preselected normal ambient temperature and for releasing said pawl member in response to at least a preselected increase in said ambient temperature whereby said pawl member and said mounting member may then slide relative to each other, said bimetallic means further comprising a latching means for at least receiving and engaging at least a portion of said pawl member when said pawl is moved relatively away from said actuated position into said restrained position and in response to at least said normal temperature, said bimetallic means further comprising a bimetal, and said latching means further comprising a pin attached to said bimetal, said pin having at least one beveled surface and said pawl having at least one recess defined therein adapted to receive said pin when said pawl is in the restrained position relative to said mounting member and said ambient temperature is said normal temperature.

2. A heat responsive releasing device, comprising:

(a) a mounting member;

(b) a pawl member slidably engaging said mounting member; and (c) bimetallic means mounted on said mounting means for restraining said pawl member relative to said mounting member in response to a preselected normal ambient temperature and for releasing said pawl member in response to at least a preselected increase in said ambient temperature whereby said pawl member and said mounting member may then slide relative to each other, said bimetallic means further comprising actuator means for additionally releasing said pawl member in response to a remote signal received thereby.

3. The invention of claim 2 wherein said signal is electrical.

4. The invention of claim 2 wherein said signal is a mechanical signal.

5. The invention of claim 4 wherein said mechanical signal is a pneumatic signal.

6. The invention of claim 2 wherein said actuator means further comprises an actuator and an actuating member movable in response to said actuator to release said pawl.

7. The invention of claim 6 wherein said bimetallic means further comprises at least one bimetal and wherein said actuating member engages said bimetal to selectively move said bimetal to release said pawl.

8. The invention of claim 7 wherein said actuator and said bimetal are mounted on generally opposing surfaces of said mounting member, said actuating member being disposed adjacent to at least one intermediate surface of said mounting member.

9. The invention of claim 8 wherein at least a portion of said mounting member extends through an aperture defined in said actuating member.

* * * * *